US007806258B2

(12) United States Patent
Smith et al.

(10) Patent No.: US 7,806,258 B2
(45) Date of Patent: Oct. 5, 2010

(54) INSERTS FOR MULTIPLE COMPONENT CONTAINERS

(75) Inventors: Matthew Eric Smith, Isle of Man (GB); Karl Mondszein, Mansfield (GB)

(73) Assignee: Carbonite Corporation, Panama City (PA)

( * ) Notice: Subject to any disclaimer, the term of this patent is extended or adjusted under 35 U.S.C. 154(b) by 101 days.

(21) Appl. No.: 12/374,042

(22) PCT Filed: Jul. 12, 2007

(86) PCT No.: PCT/GB2007/002608

§ 371 (c)(1),
(2), (4) Date: Feb. 20, 2009

(87) PCT Pub. No.: WO2008/012499

PCT Pub. Date: Jan. 31, 2008

(65) Prior Publication Data

US 2009/0308765 A1 Dec. 17, 2009

(30) Foreign Application Priority Data

Jul. 26, 2006 (GB) ..... 0614873.8
Nov. 14, 2006 (GB) ..... 0622698.9

(51) Int. Cl.
*B65D 25/08* (2006.01)

(52) U.S. Cl. ..... 206/221; 206/219

(58) Field of Classification Search ..... 206/219–222, 206/568; 215/6, 10, DIG. 8; 222/83, 129
See application file for complete search history.

(56) References Cited

U.S. PATENT DOCUMENTS 4,024,952 A * 5/1977 Leitz ..... 206/221

(Continued)

FOREIGN PATENT DOCUMENTS

JP 2000072185 A 3/2000

(Continued)

OTHER PUBLICATIONS

PCT International Search Report for PCT/GB2007/002608 dated Oct. 31, 2007.

*Primary Examiner*—Luan K Bui
(74) *Attorney, Agent, or Firm*—Harry K. Ahn; Ableman Frayne & Schwab

(57) ABSTRACT

An insert for a multiple component container includes an upper seal member (10), a depending annular wall (22) sealed to the underside of the seal member (10), a depending spigot (20) connected to the underside of the seal member (10) and a movable wall (28; 60) carried by the depending wall (22). The seal member (10), the depending wall (22) and the movable wall (28; 60) define an interior space. The movable wall (28; 60) is movable with respect to the depending wall (22) under the action of a pressure within the interior space and affording a discharge aperture (32), within which the spigot (20) is slidingly and sealingly received. The interior space accommodates a movable piston member (8), which divides the interior space into a gas space (46) and an ingredient space (44) below it. The outer edge of the piston member (8) forms a sliding seal with the inner surface of the depending wall (22) and a hole is formed in the piston member in which the spigot (20) is slidingly and sealingly received. A gas supply pathway (34) communicates with the gas space (46) and is constructed to permit gas to flow from the exterior of the depending wall (22) into the gas space but substantially to prevent flow in the opposite direction.

13 Claims, 4 Drawing Sheets

U.S. PATENT DOCUMENTS

| | | | | |
|---|---|---|---|---|
| 4,197,943 | A * | 4/1980 | Weikel | 206/219 |
| 5,330,048 | A * | 7/1994 | Haber et al. | 206/221 |
| 5,335,773 | A * | 8/1994 | Haber et al. | 206/221 |
| 7,588,142 | B1 * | 9/2009 | Bush | 206/221 |
| 2007/0163898 | A1 * | 7/2007 | Smith et al. | 206/219 |

FOREIGN PATENT DOCUMENTS

| | | | |
|---|---|---|---|
| WO | WO 93/24384 | A1 | 12/1993 |
| WO | WO 2005/097615 | A1 | 10/2005 |

* cited by examiner

INSERTS FOR MULTIPLE COMPONENT CONTAINERS

CROSS REFERENCE TO RELATED APPLICATIONS

This application is a national phase of PCT application No. PCT/GB2007/002608, filed Jul. 12, 2007, which claims priority to GB patent applications No. 0614873.8, filed Jul. 26, 2006, and No. 0622698.9, filed Nov. 14, 2006, all of which are incorporated herein by reference.

The present invention relates to inserts for multiple component containers, which contain two or more different substances or components which are stored separately but are mixed together at the time the container is opened.

There are many fields in which multiple component, particularly binary component, containers are used or are desirable. Thus, there are certain pharmaceutical compositions which are administered in the form of a mixture but which are unstable in the long term in the form of a mixture. The components of such a composition are therefore stored separately and only mixed shortly before administration. In this case, both components are generally in liquid form but it is also possible for one of the components to be in solid or powder form. Such containers may also find application in the foodstuff market, particularly for beverages. thus it is desirable, for instance in connection with canned or bottled lager and lime, only to mix the lime into the lager shortly before consumption of the beverage. A further field of application is the cosmetics industry in which certain hair colorants comprise a solvent and a pigment which are unstable in the long term, when mixed together.

It is the object of the invention to provide an insert and a lid including an insert for a multiple component container which is simple and cheap and which enables one component in the container to be reliably automatically mixed with a second component in the container as the container is opened.

According to the present invention an insert for a multiple component container includes an upper seal member, a depending annular wall sealed to the underside of the seal member, a depending spigot connected to the underside of the seal member and a movable wall carried by the depending wall, the seal member, the depending wall and the movable wall defining an interior space, the movable wall being movable with respect to the depending wall under the action of a pressure within the interior space and affording a discharge aperture within which the spigot is slidingly and sealingly received, the interior space accommodating a movable piston member, which divides the interior space into two spaces, a gas space and an ingredient space below it, the outer edge of the piston member forming a sliding seal with the inner surface of the depending wall and a hole being formed in the piston member in which the spigot is slidingly and sealingly received, a gas supply pathway communicating with the gas space, the gas supply pathway being constructed to permit gas to flow from the exterior of the depending wall into the gas space but substantially to prevent flow in the opposite direction.

In use, the ingredient space will be filled with one component, preferably in liquid, gel or paste form, of a multiple component system and the insert will be placed inside a container including a further component of the multiple component system. Once the container has been sealed by means of a lid or other closure, which may be separate from the insert or may be connected to it, the interior of the container, that is to say the head space above the component situated within it, is pressurised. If the component within the container is a carbonated beverage, this pressurisation will occur automatically by virtue of the progressive release of carbon dioxide from it. If, however, the component within the container is not carbonated and is e.g. a pharmaceutical preparation, this pressurisation of the head space of the container may be conveniently effected by adding a few drops of e.g. liquid nitrogen into the container immediately before it is sealed. Vaporisation of the nitrogen will commence immediately and the initial vaporisation will result in the atmospheric air in the head space being replaced by the nitrogen. Subsequent vaporisation of the nitrogen after application of the sealing lid will result in pressurisation of the head space. The gas supply pathway will admit pressurised gas into the gas space, whereby the pressure within the gas space will reach a value substantially the same as that in the pressurised head space of the container. When the container lid is removed, the head space of the container will be instantly depressurised. However, the gas supply pathway in the depending wall is constructed substantially to prevent flow of gas out of the gas space, that is to say to prevent it entirely or to permit it only slowly. This means that a substantial pressure differential is instantaneously created across both the piston member and the movable wall. The action of this pressure differential on the movable wall results in downward movement of the movable wall, that is to say movement away from the seal member. The discharge aperture in the movable wall thus moves away from the seal member until sufficient movement has occurred that the discharge aperture in the movable wall no longer cooperates with the spigot, whereby the aperture in the movable wall is now open and the ingredient space communicates with the interior of the container. Simultaneously with movement of the movable wall, the pressure differential acting on the movable piston member results in it also moving away from the seal member. This movement exerts a pressure on the ingredient within the ingredient space which is thus forcibly discharged through the discharge aperture in the movable wall. The container therefore now contains a two-component mixture which may then, for instance, be drunk or administered to a patient, depending of course on the nature of the mixture.

In one embodiment of the invention, the movable wall is integral with the depending wall and connected to it by at least two annular fold lines of opposite sense, within which the discharge aperture is formed. When the container seal is broken, the pressure differential acting within the interior space results in instantaneous downward movement of the movable wall by virtue of the annular portions on each side of each fold line moving in rotation in opposite directions relative to one another.

In an alternative embodiment, the movable wall includes a base connected to an upstanding annular wall, which is in sliding engagement with the depending wall, whereby the movable wall cooperates with the depending wall in the manner of a piston and cylinder. When the container seal is broken, the pressure differential acting within the interior space acts on the base of the depending wall and the depending wall therefore moves away from the seal member in the manner of a piston within a cylinder or a telescope. Although the depending wall and the movable wall are movable relative to one another, it is nevertheless desirable for them to be movable together as a unit so that the insert or lid of which the insert forms part may be removed from the container as a single unit. Thus in one embodiment, the depending wall and the upstanding wall carry respective projections which cooperate to permit only limited relative sliding movement, whereby the depending wall and the movable wall are connected together.

The gas supply pathway may simply constitute a very small opening or other leakage path in the depending wall. Such a leakage opening may have a diameter of less than 0.5 mm, e.g. 0.15 to 0.3 mm. Such an opening will permit gas to flow slowly into the gas space from the head space of the container, thereby pressurising the gas space. However, when the gas seal between the lid and the container is broken, thereby depressurising the head space of the container, the small diameter of the gas supply opening means that gas can escape from it only very slowly, whereby the high pressure in the gas space is maintained for a period of time of at least a few seconds. This period is more than adequate for the contents of the ingredient space to be ejected into the container.

Alternatively, the gas supply opening may include a non-return valve. In a simple form of the invention, a resilient lug depends from the underside of the seal member and engages the inner side of the depending wall over the gas supply opening and constitutes with it a non-return valve.

In one embodiment of the invention, the outer edge of the piston member constitutes a relatively massive flange, in whose upper surface a cut-out is formed at a predetermined circumferential position, the gas supply opening communicating with the gas space through the cut-out.

In a yet further alternative, the gas supply pathway constitutes a gas leakage path defined between the spigot and the margins of the discharge aperture and the hole in the piston member. Thus if the seal between the spigot and the movable wall and the piston member is less than perfect, the leakage path thus defined will again permit gas to flow slowly from the head space of the container into the gas space. However, when the container head space is depressurised, the gas leakage path will permit gas to escape from it only slowly, whereby the high pressure in the gas space is maintained for a sufficient period of time to enable the contents of the ingredient space to be discharged.

In the preferred embodiment the spigot and/or the piston member carries an abutment which is engaged by the piston member or seal member, respectively, and maintains a predetermined minimum distance between the seal member and the piston member.

In practice, the insert in accordance with the invention is likely to be used with a container lid or closure. The insert may be provided with a separate seal member and the entire insert may then be connected to the underside of a container lid or simply push-fitted within the lid. This separate seal member is preferably integrally connected to the diaphragm member, e.g. by an integral hinge. This permits the two components to be manufactured in the form of a single injection moulding. It is, however, preferred that the lid includes a lid plate to which the upper end of the depending wall is sealed, whereby the lid plate constitutes the seal member.

The invention also embraces a multiple component container with a neck defining an opening sealed by a lid of the type referred to above, the depending wall being integral at its upper end with a radially outwardly extending flange, the flange being sandwiched between the underside of the lid plate and the upper surface of the neck of the container. Container lids are generally applied with a certain pressure and the sandwiching of the flange on the depending wall between the neck of the bottle and the lid plate will not only retain the insert in position but will also enhance the seal between the depending wall and the lid plate. Indeed, whilst the depending wall or the flange on it may be physically connected, e.g. welded, to the lid plate, this is not absolutely necessary and the seal between the flange and the lid plate could be created solely by the contact pressure exerted on them as a result of the screw threads or the like on the lid.

Further features and details of the invention will be apparent from the following description of three specific embodiments which is given by way of example only with reference to the accompanying drawings, in which.

Figure 1:
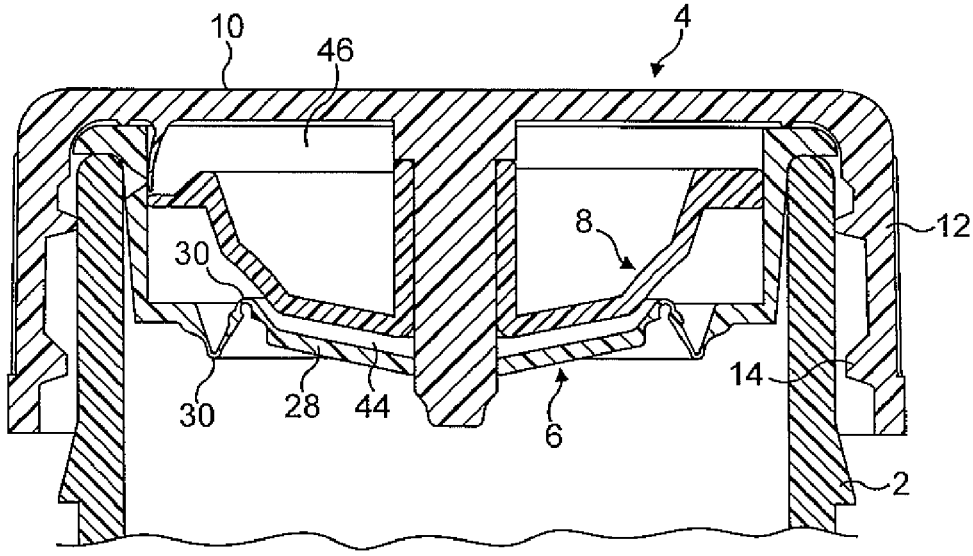
FIG. 1 is an axial sectional view of a lid in accordance with the invention on the neck of a bottle before the lid has been loosened for the purpose of removing it.

FIG. 1 shows the lid sealed to the neck 2 of a carbonated beverage bottle. The lid comprises a cap member 4, a diaphragm member 6 and a piston member 8. These three members are injection moulded plastic components of e.g. polyethylene or polypropylene.

The cap member comprises a circular generally planar lid plate 10, which, in use, extends over the mouth of the bottle or other container. Integrally connected to its outer edge is a depending skirt 12. In this case, the inner surface of the skirt 12 carries short start screw threads 14, though the cap may be connected to the bottle in any conventional manner. Integral with the underside of the lid plate 10 is an annular sealing bead or ridge 16 and situated inwardly from it is an integral depending lug 18. Also extending integrally from the centre of the underside of the lid plate is a spigot 20. The function of these elements will be described below.

Situated within the space defined by the cap member 4 is the diaphragm member 6, which comprises a stationary portion and a movable portion. The stationary portion comprises an annular depending wall 22, integral with whose upper end is a radially outwardly extending, annular sealing flange 24 and integral with whose lower end is a radially inwardly extending annular support flange 26. Connected to the inner edge of the support flange 26 is the movable portion comprising a generally circular plate 28. The movability of the portion 28 is created by the provision of a number, in this case two, of annular fold lines 30 of opposite sense. A discharge aperture 32 is formed in the centre of the movable portion 28. Formed at the top of the wall 22 is a gas supply aperture 34 of small diameter, e.g. 1 mm or less, in this case 0.2 mm.

The piston member 8 comprises a substantially rigid, circular dished plate 36, formed at whose outer edge is a relatively massive sealing flange 38. A cut-out 40 is formed in the upper surface of the flange 38 at one circumferential position. Formed in the centre of the plate 36 is a hole, extending around which is an open-ended tube 42, which is integral with and upstanding from the margin of the hole.

In use, the upper surface of the flange 24 is sealed to the underside of the lid plate 10, and the integrity of this seal is enhanced by the sealing bead 16. The seal may be created by welding or adhesive or may just rely on the pressure exerted on the flange 24 by the cap member, when it is fastened to the bottle and sandwiches the flange 24 between the cap member and the rim of the bottle. The diaphragm member and cap member are angularly orientated with respect to one another such that the sealing lug 18, which is deformed inwardly somewhat against its own resilience, engages the inner surface of the wall 22 over the aperture 34. The lug 18 and aperture 34 thus constitute a one-way valve which will permit gas to flow into but not out of the interior of the diaphragm member.

Before the cap member 4 and diaphragm member 6 are sealed together, the tube 42 of the piston member is slid over the spigot 20 on the cap member and forms a sliding seal with it. The spigot 20 is also pushed through the discharge aperture 32 in the diaphragm member, with which it also forms a sliding seal. The piston member and the diaphragm member are angularly orientated with respect to one another such that the gas aperture 34 is aligned with the cut-out 40 in the flange 38 of the piston member.

The diaphragm member and cap member thus define a space, which is divided into two spaces by the piston member 8. The lower space 44 is referred to as an ingredient space and the upper space 46 is referred to as a gas space. The gas space 46 communicates with the gas aperture 34 via the cut-out 40.

In order to ensure that the piston member 8 does not move too close to the lid plate 10, thereby making the gas space 46 too small, the spigot 20 carries an abutment which prevents movements of the piston member beyond a predetermined position. In this case the abutment comprises a downwardly directed annular shoulder 21 formed on the spigot, which is engaged by the hollow tube 42.

Figure 2:
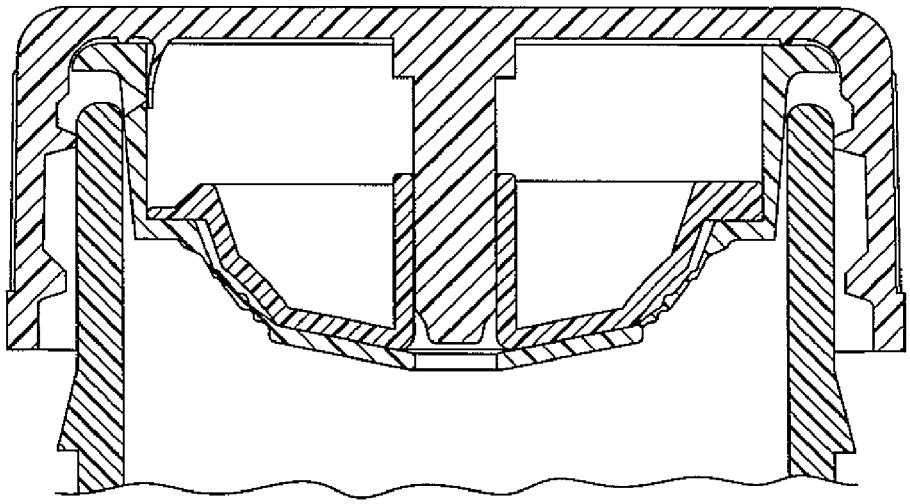
FIG. 2 is a view similar to FIG. 1 showing the lid after the lid has been loosened and the gas seal with the bottle has been broken.
Figure 3:
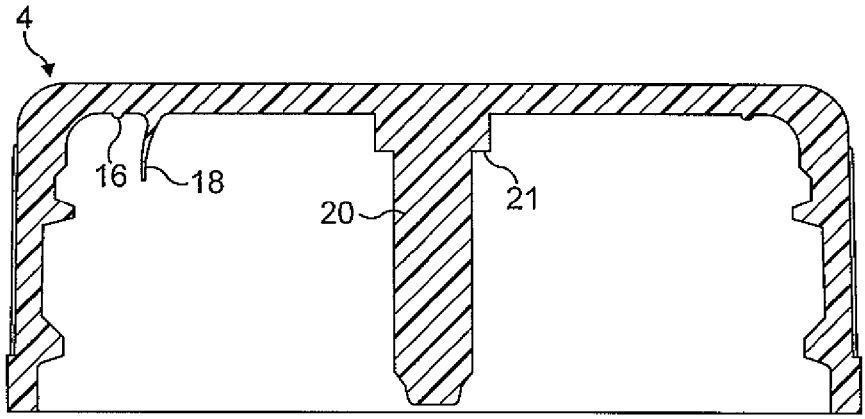
FIGS. 3, 4 and 5 are axial sectional views of the three components of the lid, namely the cap member, the diaphragm member and the piston member, respectively.
Figure 4:
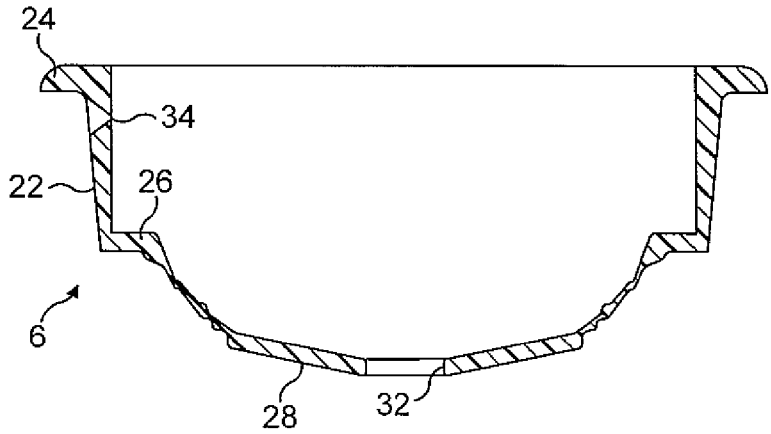
Figure 5:
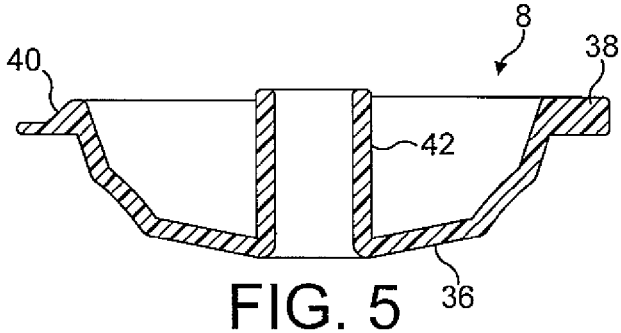
Figure 6:
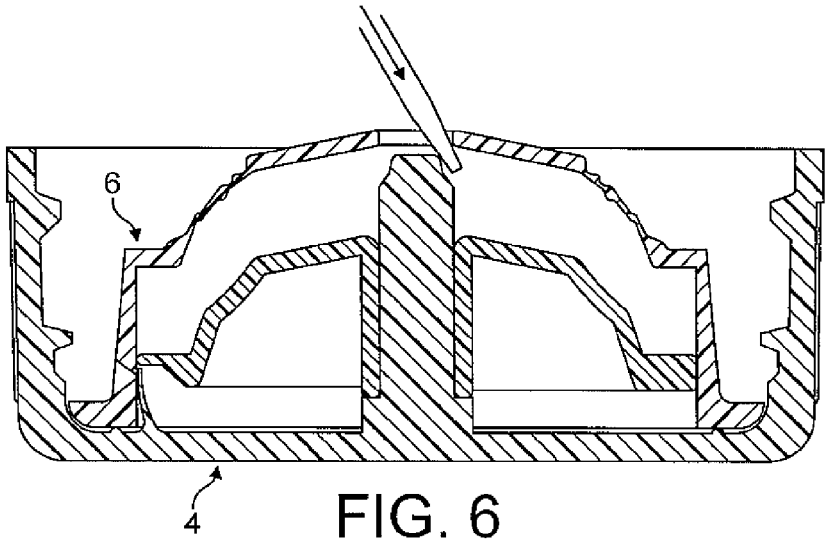
FIGS. 6 and 7 illustrate the filling of the ingredient space.
Figure 7:
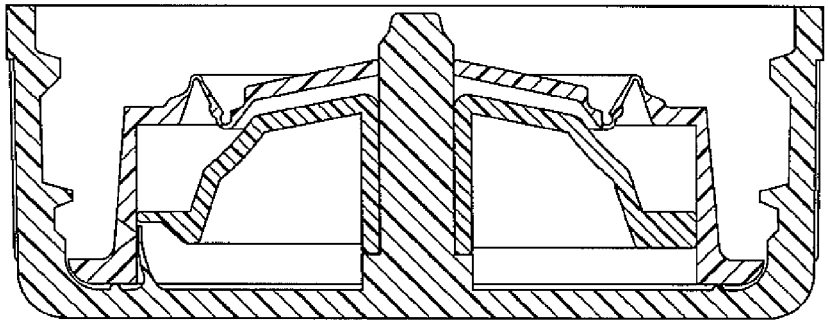

The ingredient space 44 is filled during assembly with a preselected ingredient, for instance lime syrup if the bottle is intended to contain lager and lime. This may be done in any desired manner but one possibility is illustrated in FIGS. 6 and 7. The cap member 4 is initially inverted and the piston member is then positioned within it and the tube 42 is slid down the spigot 20 until its free end engages the shoulder 21. The diaphragm member 6 is then inserted into the cap member with its internal surface in sealing contact with the peripheral edge of the piston member. Alternatively, the piston member may be placed within the diaphragm member and the two members are then inserted into the cap member together. The diaphragm member is then optionally sealed to the cap member. When the diaphragm member is inserted, the movable wall portion is not initially slid over the spigot and it is then bent away, as shown in FIG. 6, to provide access to the ingredient space 44 for an ingredient injection nozzle 45. The ingredient, in this case lime syrup, is then injected into the ingredient space. The movable wall portion of the diaphragm member is then slid over the spigot, which forms a sliding seal with the surface of the discharge aperture in the movable wall portion. The configuration is then as shown in FIG. 7, which is essentially the same as FIG. 1. The bottle is now filled, in this case with lager, and as soon as the lid is sealed to the bottle, carbon dioxide liberated from the lager will progressively increase the pressure in the head space of the bottle to a substantial superatmospheric value. This pressure acts on the gas aperture 34 and displaces the lug 18 somewhat inwardly and the gas space 46 is thus progressively pressurised also until the pressure in the gas space is substantially equal to the pressure in the head space of the bottle. When the contents of the bottle are to be drunk, the lid is removed. As the removal process starts, the seal between the lid and the neck of the bottle is broken and the pressure in the head space of the bottle drops virtually instantaneously to atmospheric pressure. However, the sealing lug 18 is biased by its resilience against the inner surface of the wall 2 and the gas supply aperture is therefore sealed. The pressure in the gas space is thus maintained and there is thus a substantial pressure differential across both the piston member 8 and the movable portion 28 of the diaphragm member. The movable member 28 thus moves downwardly under the influence of this pressure differential and such movement is permitted by the fold lines 30. The annular portions of the diaphragm member on each side of each fold line thus rotate in opposite senses relative to one another. After moving a short distance, the discharge aperture 32 in the diaphragm member moves out of engagement with the spigot 20 and the ingredient space is no longer sealed but communicates with the head space of the bottle through the aperture 32. As the movable portion 28 of the diaphragm member moves downwardly so too does the piston member 8 under the action of the pressure differential across it. This movement exerts a pressure on the lime syrup and forcibly ejects the syrup through the aperture 32 into the bottle and thus into the lager within the bottle. The piston member and movable portion of the diaphragm member thus move from the positions shown in FIG. 1 to those shown in FIG. 2. The forcible ejection of the syrup occurs very rapidly and is completed within the short time interval between breaking the gas seal between the lid and the bottle and removal of the lid from the bottle. Thus by the time it is possible to dispense the contents of the bottle, the lager and lime syrup are already mixed together.

Figure 8:
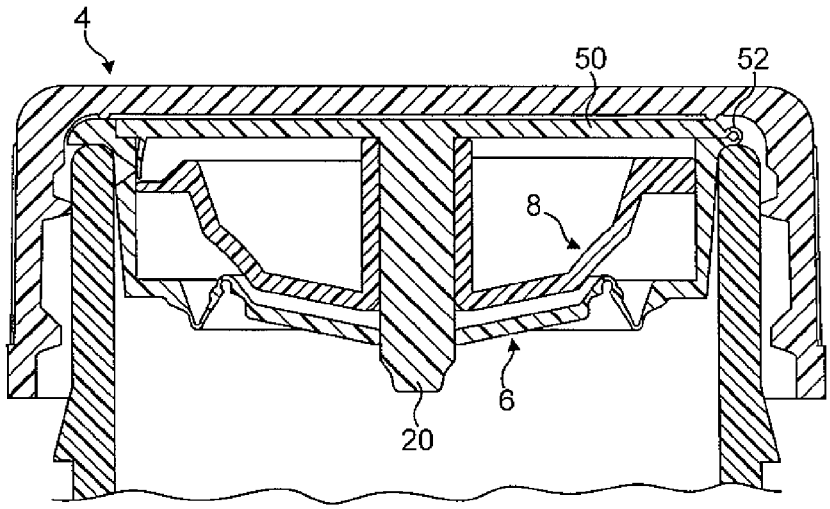
FIG. 8 is a view similar to FIG. 1 of an insert in accordance with the invention retained within a container lid.

The above description relates to a container lid in which the lid plate forms the seal member for the insert. However, FIG. 8 shows a modified embodiment in which the seal member comprises a separate plate. This plate is in this case integral with the diaphragm member and connected to the upper outer edge of the diaphragm member at one circumferential position by an integral hinge 52. The seal member 50 comprises a circular plate, integral with which is the spigot 20. Accordingly, the insert shown in FIG. 8 comprises the diaphragm member 6, the seal plate 50 and the piston member 8. This insert may then be placed within a cap member 4 and secured to it, e.g. by heat sealing or adhesive or it may simply be a push fit. In this case the shoulder 21 has been omitted and the abutment is constituted by the free end of the tube 42, which is pushed into contact with the underside of the sealing plate 50. In all other respects, the insert is as described in relation to FIGS. 1 to 5.

Figure 9:
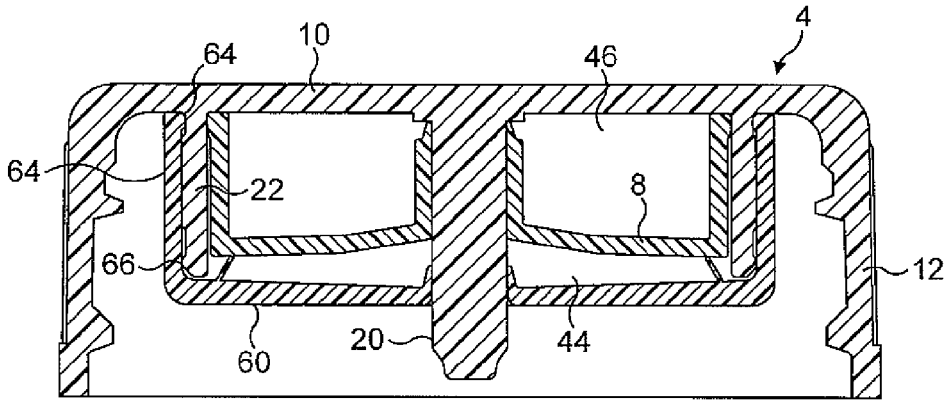
FIG. 9 is an axial sectional view of a modified embodiment of lid in accordance with the invention before the lid has been loosened from the associated container.
Figure 10:
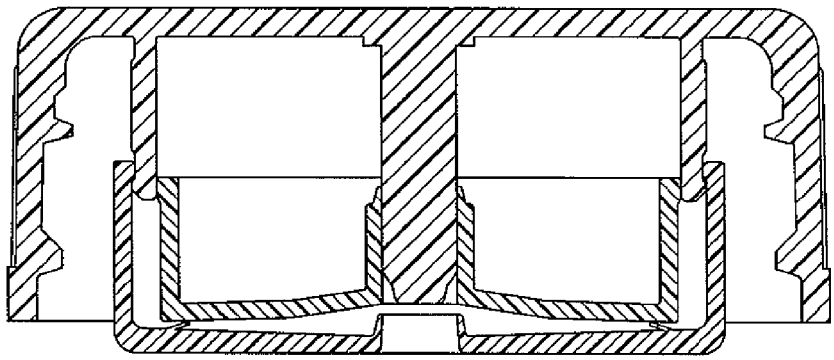
FIG. 10 is a view similar to FIG. 9 showing the lid after it has been loosened from the bottle and the gas seal has been broken.

A modified container lid is shown in FIGS. 9 and 10 which differs from the embodiment of FIGS. 1 to 7 in several important respects. Thus firstly, the depending annular wall 22 is integral with the lid plate 10, whereby the lid plate 10, the depending skirt 12, the spigot 20 and the depending wall 22 all constitute part of a one-piece injection moulding. Secondly, the movable wall has no annular fold lines formed in it but is instead of generally cup shape and comprises a circular base 60, integral with whose outer edge is an upstanding annular wall 62. The internal surface of the wall 62 is in sliding engagement with the external surface of the depending wall 22 and the movable wall therefore cooperates with the depending wall 22 of the cap member in the manner of a piston and cylinder. Formed at the top of the internal surface of the wall 62 is a peripheral bead or projection 64 and formed at the bottom of the external surface of the depending wall 22 is a similar peripheral bead or projection 66. The presence of these two projections 64, 66 means that only limited sliding movement of the movable portions 60, 62 away from the cap member is possible and once the two projections 64, 66 come into engagement, further movement is prevented, whereby the cap member and the movable portions 60, 62 may be moved together as a unit. Thirdly, there is in this case no gas supply aperture in the depending wall 22, though such an aperture could be provided, and in this case the necessary gas supply pathway extending between the exterior of the lid and the gas space 46 is provided by the fact that the sliding seal between the outer surface of the spigot and the discharge aperture in the base 60 and the hole in the movable piston 8 is less than perfect. A gas leakage path is therefore defined, through which, in use, gas may leak slowly from the pressurised head space of the container into the ingredient space 44 and thence into the gas space 46. In all other material respects, the embodiment of FIGS. 9 and 10 is substantially the same as that of FIGS. 1 to 7.

Thus when the lid is applied to a bottle, the pressure in the gas space 46 rises progressively to equal that in the head space of the bottle as a result of leakage through the gas leakage pathway described above. When the lid is loosened on the container and the gas seal broken, the pressure in the head space of the bottle drops instantaneously to atmospheric whilst the pressure in the gas space 46 remains at a high level because the rate of gas flow through the gas leakage path is very small. The pressure differential acting on the base 60 results in the movable portions 60, 62 rapidly moving downwards until the projections 64, 66 are in contact with one another. In the course of this movement, the spigot 42 moves out of the discharge aperture in the base 60. Whilst this movement is occurring, the pressure differential acting on the movable piston member 8 causes it to move downwards also, thereby expelling whatever liquid is within the ingredient space 44 through the discharge aperture 32 into the body of the bottle. This occurs before unscrewing of the lid from the bottle has been completed and when the cap member is removed from the bottle, the movable portions 60, 62 and the piston member 8 are removed with it.

Whilst the above description relates to a two-component container, it will be appreciated that the invention is equally applicable to containers for three or even more components. In this event, a correspondingly increased number of inserts filled with different substances are inserted into the container, e.g. all connected to and sealed by the lid plate of the lid of the container.

The invention claimed is:

1. An insert for a multiple component container including an upper seal member, a depending annular wall sealed to the underside of the seal member, a depending spigot connected to the underside of the seal member and a movable wall carried by the depending wall, the seal member, the depending wall and the movable wall defining an interior space, the movable wall being movable with respect to the depending wall under the action of a pressure within the interior space and affording a discharge aperture, within which the spigot is slidingly and sealingly received, the interior space accommodating a movable piston member, which divides the interior space into two spaces, a gas space and an ingredient space below it, the outer edge of the piston member forming a sliding seal with the inner surface of the depending wall and a hole being formed in the piston member in which the spigot is slidingly and sealingly received, a gas supply pathway communicating with the gas space, the gas supply pathway being constructed to permit gas to flow from the exterior of the depending wall into the gas space but substantially to prevent flow in the opposite direction.

2. An insert as claimed in claim 1 in which the movable wall is integral with the depending wall and connected to it by at least two annular fold lines of opposite sense within which the discharge aperture is formed.

3. An insert as claimed in claim 1 in which the movable wall includes a base connected to an upstanding annular wall which is in sliding engagement with the depending wall, whereby the movable wall cooperates with the depending wall in the manner of a piston and cylinder.

4. An insert as claimed in claim 3 in which the depending wall and the upstanding wall carry respective projections which cooperate to permit only limited relative sliding movement, whereby the depending wall and the movable wall are connected together and may be moved together as a unit.

5. An insert as claimed in claim 1 in which the gas supply pathway constitutes a gas leakage path extending through the depending wall which is dimensioned so that gas can flow through it only relatively slowly.

6. An insert as claimed in claim 5 including a resilient lug which depends from the underside of the seal member and engages the inner surface of the depending wall over the gas supply opening and constitutes with it a non-return valve.

7. An insert as claimed in claim 5 in which the outer edge of the piston member constitutes a relatively massive flange, in whose upper surface a cut-out is formed at a predetermined circumferential position, the gas supply opening communicating with the gas space through the cut-out.

8. An insert as claimed in claim 1 in which the gas supply pathway constitutes a gas leakage path defined between the spigot and the margins of the discharge aperture and the hole in the piston member.

9. An insert as claimed in claim 1 in which the seal member comprises a plate integrally connected to the depending wall.

10. An insert as claimed in claim 1 in which the spigot and/or the piston member carries an abutment which is engaged by the piston member or seal member, respectively, and maintains a predetermined minimum distance between the seal member and the piston member.

11. A lid for a multiple component container including an insert as claimed in claim 1.

12. A lid as claimed in claim 11 in which the lid includes a lid plate to which the upper end of the depending wall is sealed, whereby the lid plate constitutes the seal member.

13. A multiple component container with a neck defining an opening sealed by a lid as claimed in claim 11, the depending wall being integral at its upper end with a radially outwardly extending flange, the flange being sandwiched between the underside of the lid plate and the upper surface of the neck of the container.

* * * * *